US007578411B1

(12) United States Patent
Zien et al.

(10) Patent No.: US 7,578,411 B1
(45) Date of Patent: Aug. 25, 2009

(54) BUCKET BAIL GRIP

(75) Inventors: Jerry J. Zien, Prior Lake, MN (US); Kenneth C. Floer, Chaska, MN (US)

(73) Assignee: Miller Manufacturing Company, Inc., Eagan, MN (US)

( * ) Notice: Subject to any disclaimer, the term of this patent is extended or adjusted under 35 U.S.C. 154(b) by 150 days.

(21) Appl. No.: 11/472,931

(22) Filed: Jun. 22, 2006

(51) Int. Cl.
*B65D 25/32* (2006.01)

(52) U.S. Cl. ..... 220/760; 220/751; 220/755; 220/761; 220/773

(58) Field of Classification Search ..... 220/760, 220/761, 773, 776, 480, 481, 755, 751, 756, 220/475; 248/301
See application file for complete search history.

(56) References Cited

U.S. PATENT DOCUMENTS

| | | | | | |
|---|---|---|---|---|---|
| 181,516 | A | * | 8/1876 | Fitzhugh | 294/68.26 |
| 356,895 | A | * | 2/1887 | Sangster | 220/760 |
| 459,253 | A | * | 9/1891 | Metz | 220/212.5 |
| 679,887 | A | * | 8/1901 | Clark | 248/211 |
| 1,157,475 | A | * | 10/1915 | Webster | 220/553 |
| 1,219,402 | A | * | 3/1917 | Rutan | 294/68.27 |
| 1,488,397 | A | * | 3/1924 | Judge et al. | 220/23.4 |
| 1,492,453 | A | * | 4/1924 | Haines | 220/9.1 |
| 1,545,740 | A | * | 7/1925 | Cowell | 248/211 |
| 1,678,005 | A | * | 7/1928 | Hallerman | 294/171 |
| 2,012,932 | A | * | 8/1935 | Yarbrough | 220/760 |
| 2,156,274 | A | * | 5/1939 | Brown | 217/125 |
| 2,287,329 | A | * | 6/1942 | Santa Maria et al. | 294/171 |
| 2,294,197 | A | * | 8/1942 | Moore et al. | 220/755 |
| 2,398,436 | A | * | 4/1946 | Mason | 220/752 |
| 2,466,840 | A | * | 4/1949 | Crawford | 248/210 |
| 2,470,463 | A | * | 5/1949 | Botten | 119/65 |
| 2,577,001 | A | * | 12/1951 | Cole | 220/760 |
| 3,329,321 | A | * | 7/1967 | Moore | 222/465.1 |
| 3,578,205 | A | * | 5/1971 | Ballester | 220/694 |
| 3,619,852 | A | * | 11/1971 | Eckberg | 16/425 |
| 4,244,469 | A | * | 1/1981 | Miner | 206/349 |
| 4,364,150 | A | * | 12/1982 | Remington | 16/409 |
| 4,452,415 | A | * | 6/1984 | Arnold | 248/312.1 |
| 4,823,433 | A | * | 4/1989 | Curtis | 16/411 |
| 4,890,355 | A | * | 1/1990 | Schulten | 16/421 |
| 5,251,781 | A | * | 10/1993 | Skelton | 220/755 |
| 5,320,319 | A | * | 6/1994 | Winger et al. | 248/312.1 |
| 5,445,425 | A | * | 8/1995 | Lyver | 294/31.2 |
| D369,549 | S | * | 5/1996 | Meyers et al. | D9/434 |
| 5,687,941 | A | * | 11/1997 | Quintile | 248/210 |
| 5,738,401 | A | * | 4/1998 | Fan | 294/171 |

(Continued)

*Primary Examiner*—Anthony D Stashick
*Assistant Examiner*—Christopher B McKinley
(74) *Attorney, Agent, or Firm*—James W. Miller

(57) ABSTRACT

A bail grip for a pivotal bail of a bucket in which the bail has a pair of bail legs and a central hook with an inverted shape. The bail grip comprises an arcuate body that is installed onto the upper ends of the bail legs with the arc of the bail grip body conforming to a common curve or arc of the upper ends of the bail legs. When in place, the bail grip body does not completely close off a recess formed by the hook. Instead, a rear side of the bail grip body has a notch adjacent the recess such that a locking pin used on a wall bracket from which the bucket is hung is still able to pass downwardly through the recess and along the notch formed in the rear side of the bail grip body.

5 Claims, 5 Drawing Sheets

U.S. PATENT DOCUMENTS 5,816,439 A * 10/1998 Lovell et al. ..... 220/760
D401,505 S * 11/1998 Michael et al. ..... D9/434
5,884,955 A * 3/1999 Pucillo ..... 294/171
6,062,415 A * 5/2000 Harper ..... 220/521
6,085,933 A * 7/2000 Brunazzo ..... 220/760
6,102,349 A * 8/2000 Hall ..... 248/312.1
6,257,440 B1 * 7/2001 Perkins et al. ..... 220/764
6,266,849 B1 * 7/2001 Petit et al. ..... 16/425
6,267,461 B1 * 7/2001 Dunagan et al. ..... 312/49
6,336,255 B1 * 1/2002 Gallup ..... 16/425
6,338,419 B1 * 1/2002 Penney ..... 220/475
6,352,169 B2 * 3/2002 Foster ..... 220/755
6,494,341 B2 * 12/2002 Perkins et al. ..... 220/764
6,497,006 B2 * 12/2002 Gallup ..... 16/425
6,779,680 B1 * 8/2004 Schwarz ..... 220/773
7,201,355 B1 * 4/2007 Zien et al. ..... 248/301
7,305,738 B2 * 12/2007 Nawrocki ..... 16/428
D565,928 S * 4/2008 Bellerose et al. ..... D8/316
7,360,665 B1 * 4/2008 Hartelius ..... 220/759
2001/0035422 A1 * 11/2001 Foster ..... 220/755
2002/0145001 A1 * 10/2002 Morelock ..... 220/755
2003/0146220 A1 * 8/2003 Kaura ..... 220/481
2006/0102638 A1 * 5/2006 Summerfield ..... 220/755

* cited by examiner

BUCKET BAIL GRIP

TECHNICAL FIELD

This invention relates to a bucket having a pivotal bail that may be gripped by a user to allow the user to grip and carry the bucket. More particularly, this invention relates to such a bucket in which the pivotal bail is shaped to allow the bucket to be hung from a wall bracket or the like and to a grip that may be installed on the pivotal bail.

BACKGROUND OF THE INVENTION

Hand held buckets are well known in many fields for carrying and transporting various liquid and solid substances. For example, paint and other construction materials are typically sold in such buckets. Such buckets typically have a cylindrical body with a closed bottom and a pivotal bail which the user grips and lifts to carry the bucket. The top of the body may be closed by a lid or cover which may subsequently be removed or opened to gain access to the contents of the bucket. Alternatively, the top of the body may simply be open without having any lid or cover.

Another common use of buckets is in the farm, ranch and pet industries. Buckets are used to carry and hold water or feed for livestock. For example, horses are often fed or watered from buckets that are hung from the walls of the stalls in which the horses are sheltered. In fact, specialized wall brackets are provided that allow the buckets to be properly and securely hung from a wall with the horse being unable to dislodge or knock the bucket off the wall. Obviously, in this application, the tops of the buckets will be open so that the horse will have access at will to the contents of the buckets.

For buckets designed to be hung from a bracket or nail located on a wall, the bail usually has an inverted central hook at the apex of the bail. If one is attempting to simply hang the bucket from a nail, this hook can be hooked onto the nail and helps center the bucket on the nail and helps prevent the bucket from sliding off the nail. When a specialized wall bracket is used, the hook forms a discontinuity or recess in the otherwise smooth and continuous arcuate shape of the bail. This recess allows a locking pin to be inserted down through the bracket and through the recess formed by the hook to help secure the bucket to the bracket.

Unfortunately, buckets used in many situations such as those outlined above are very heavy when filled, particularly when filled with animal feed or a large amount of water for a large animal, such as a horse. The bails used on such buckets are simply metal hoops having sufficient strength to allow a filled bucket to be picked up and carried without deforming the bail. However, this can be difficult to do since the relatively thin metallic bail presses into or cuts into the user's hand with a large amount of pressure. If the user is carrying the bucket a fair distance, or is repetitively carrying numerous buckets, this can be painful or damaging or both to the hands of the user.

Various grips have been applied to the bails of buckets to help make the task of carrying the bucket more comfortable. However, due to the discontinuity in the arcuate shape of the bail of a bucket having a central hook, such grips have not been applied to such bails over the central portion of the bail, including over the hook, where the grip is needed. It is difficult to apply a grip in this area of the bail.

In addition, even if a grip could be applied to the central portion of a bail having a central hook at its apex, the presence of the grip would interfere with the bucket being hung from a nail or bracket. For example, the extra thickness or material provided by the grip would take up most of the recess provided by the hook. This recess is needed to allow the locking pin on a conventional wall bracket to drop down through the recess. With a grip installed over the hook, the recess would no longer be large enough to receive the locking pin.

Accordingly, it would be an advance in the art to be able to use a grip on a pivotal bail of a bucket even when the bail has a central hook at its apex for hanging the bucket from a wall bracket.

SUMMARY OF THE INVENTION

One aspect of this invention relates to a bucket that may be hung from a hanging device attached to a wall. The bucket comprises a bucket body having a pivotal bail attached thereto for allowing the bail to be gripped and carried by hand to carry the bucket body. The pivotal bail has a central hook defining a recess. A bail grip is carried on a central portion of the bail. The bail grip is attached to the bail with the bail grip extending beneath the central hook of the bail in a manner that leaves the recess defined by the central hook of the bail sufficiently open to receive a portion of the hanging device therein.

Another aspect of this invention relates to a bail grip for use on a bail of a bucket. The bail has a pair of bail legs with the upper ends of the bail legs being joined to opposite sides of an inverted hook that forms a recess. The bail grip body is shaped to at least partially lie along the upper ends of the bail legs. The bail grip body has a central hub and laterally extending arms with the central hub and laterally extending arms of the bail grip body being long enough to span beneath the hook and over at least portions of the upper ends of the bail legs. A slot is provided in each laterally extending arm of the bail grip body. Each slot is configured to fit around the upper ends of the bail legs to attach the bail grip body to the bail legs. Each slot is also configured to allow the hook to pass outwardly through the slot and upwardly above the bail grip body such that at least a portion of the recess formed by the hook lies above the bail grip body.

Yet another aspect of this invention relates to a bail grip for a pivotal bail of a bucket in which the bail has a central hook with an inverted shape. The bail has an arcuate hoop shape with a pair of left and right bail legs joined together at the central hook. The upper ends of the bail legs lie along a common curve or arc with the hook extending upwardly therefrom to define a recess lying above the common curve or arc. The bail grip comprises an arcuate bail grip body that is installed onto the upper ends of the bail legs with at least portions of the arc of the bail grip body conforming to the common curve or arc of the upper ends of the bail legs. The bail grip body does not completely close off the recess formed by the hook when the bail grip body is installed onto the upper ends of the bail legs. A notch is provided on the bail grip body with the notch positioned such that a locking pin used on a wall bracket from which the bucket is hung is able to pass through the recess and along the notch formed in the bail grip body.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 5:
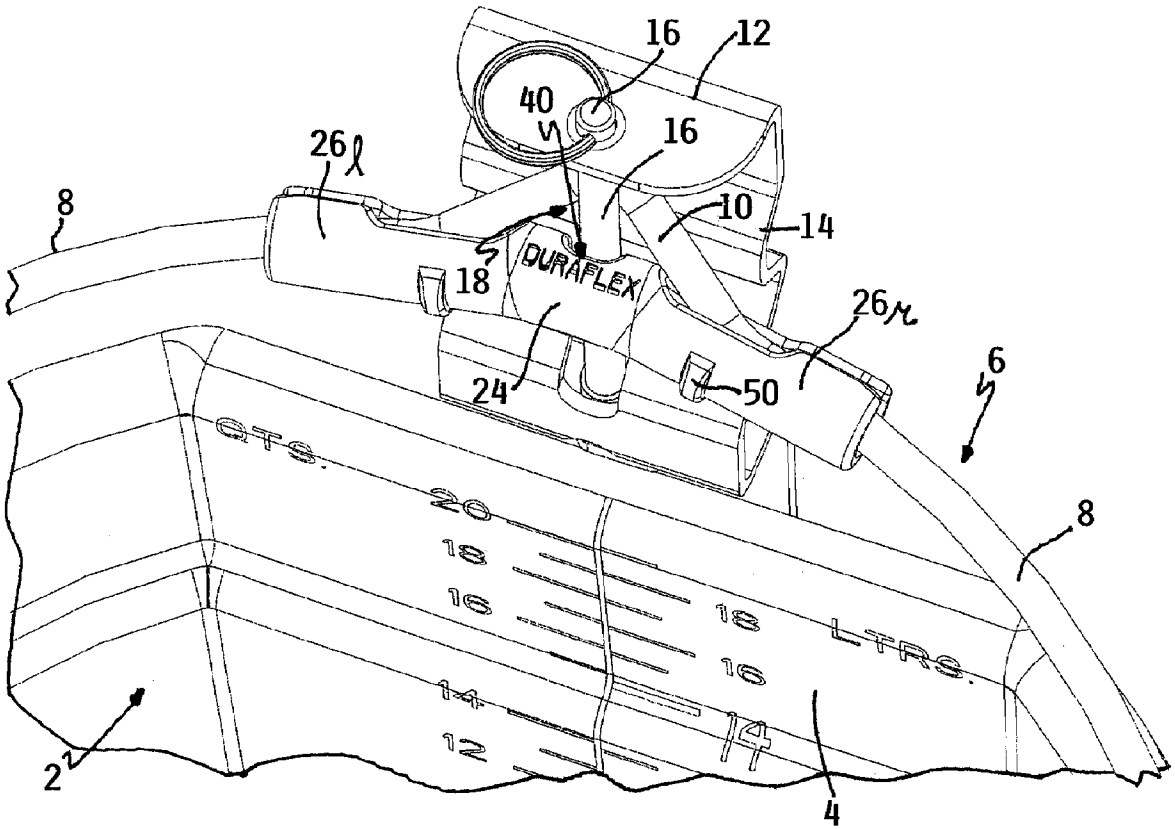
FIG. 5 is a front perspective view of bucket bail grip of FIG. 1, particularly showing the bucket bail grip having been installed on the central portion of a bucket bail and the bucket bail having been hung from a wall bracket.
Figure 6:
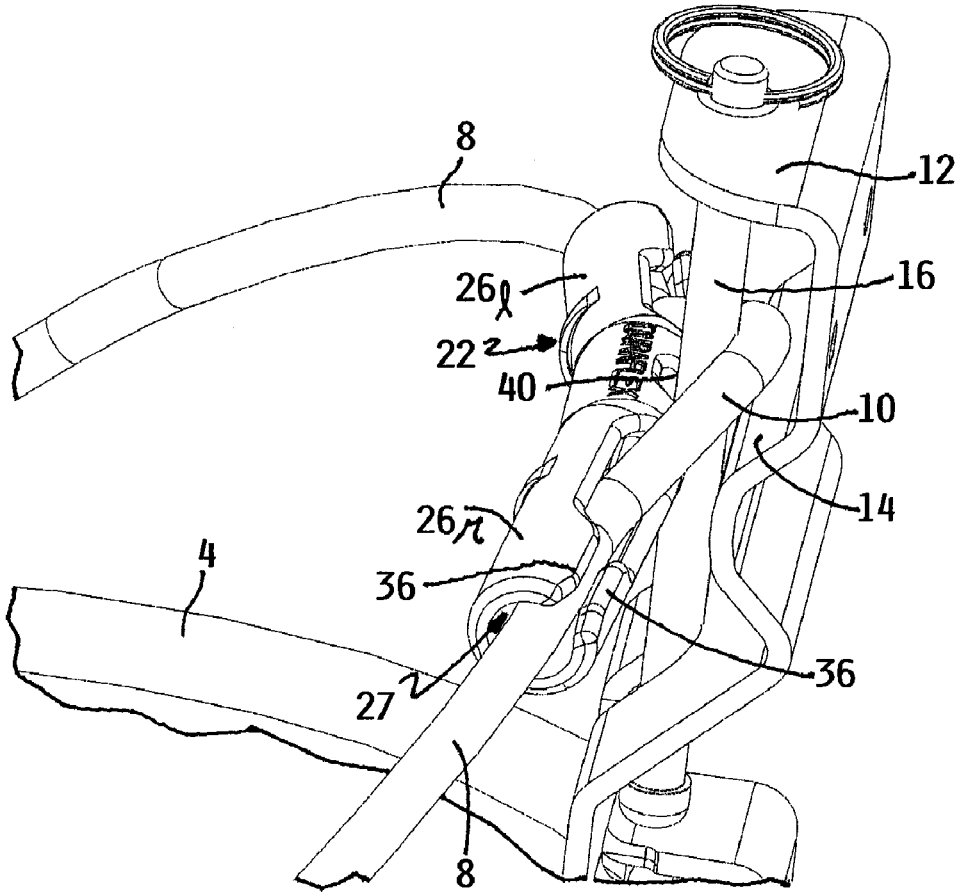
FIG. 6 is a perspective view similar to FIG. 5, but showing the bail grip, the bucket bail and the wall bracket from the side and not the front.

Referring first to FIGS. 5 and 6, a bucket of the type for which the bail grip of this invention has been designed is shown generally as 2. Bucket 2 includes an upright body 4 that is closed by a bottom wall (not shown) to provide a container that is suited for holding and carrying liquid or solid materials. Body 4 can have various cross-sectional shapes, such as a cylindrical body or a generally cylindrical body with a flat back as shown in FIGS. 5 and 6. The exact shape and carrying capacity of bucket body 4 is not important to this invention.

Bucket 2 includes a pivotal bail 6 to allow bucket 2 to be carried by hand. Bail 6 comprises an arch shaped hoop having legs 8 that define the sides of the arch. The lower ends of bail legs 8 are pivotally secured to opposite sides of bucket body 4. The lower ends of bail legs 8 and their pivotal connections to bucket body 4 are not shown in FIGS. 5 and 6—only the central portion of bail 6 is illustrated. Such pivotal bails 6 are well known in the bucket art.

The center or apex of bail 6 includes a central hook 10 that forms a discontinuity in the otherwise smooth arcuate hoop shape of bail 6. Hook 10 has an inverted shape, such as an inverted V, U or curved shape, relative to the adjoining portions of bail 6, namely relative to the upper ends of each bail leg 8 immediately adjacent hook 10. The upper ends of each bail leg 8 immediately adjacent hook 10 are mirror images of each other and lie along a common curve or arc. This common curve or arc is, of course, interrupted or broken by the inverted central hook 10 formed in bail 6.

The purpose of hook 10 is to allow bucket 2 to be easily hung and supported from a conventional wall bracket 12, a portion of which is shown in FIGS. 5 and 6, or another hanging device such as a nail, eye-bolt, snap hook etc. Such wall brackets 12 for hanging buckets 2 are well known in the farm, ranch and pet industries. Inverted central hook 10 provides side-to-side retention of bucket 2 on the hanging device such as bracket 12.

Wall brackets 12 of this type include one or more seats 14 which receive the central portion of bail 6 to hang bail 6 from seat 14. In addition, such brackets 12 include a generally vertical locking pin 16 which passes down in front of hook 10 of bail 6 to further help hold and secure bucket 2 to bracket 12. The inverted central hook 10 provides a recess 18 that is large enough to accommodate the passage of locking pin 16. While locking pin 16 is usually vertically disposed, it could be disposed in other orientations, namely an inclined or even a horizontal orientation.

Turning now to bail grip 20 of this invention, bail grip 20 includes an arcuate grip body 22. Grip body 22 is curved to generally lie along or conform to the common arc or curve which contains the upper ends of bail legs 8. However, grip body 22 could also be straight or U-shaped. Grip body 22 has a central hub 24. Left and right arms $\mathbf{26}_l$ and $\mathbf{26}_r$ extend outwardly from opposite sides of central hub 24.

At least a portion of each arm 26 of grip body 22 includes a hollow bore 27 to receive the upper end of a bail leg 8. Since bail legs 8 are cylindrical in shape, the hollow interior bore 27 of each arm 26 is also generally cylindrical in shape, though bail legs 8 and bores 27 could have other cross-sectional shapes if so desired. This allows the cylindrical cross-section of the upper ends of bail legs 8 to be closely received inside the cylindrical bores 27 of grip body 22 of bail grip 20. Each hollow bore 27 in each arm 26 of grip body 22 is open at its free outer end 28. Arms 26 could have many exterior shapes if so desired.

A pair of slots 30 are provided with one slot being located in each arm 26 of grip body 22. Slots 30 are identically shaped and so a description of one slot 30 will suffice to describe the other.

Slot 30 has a narrower outer portion 32 and a wider inner portion 34. Outer portion 32 of slot 30 has a pair of inwardly extending shoulders or tabs 36 on the edges of slot 30 along outer portion 32 of slot 30. Tabs 36 do not reach one another but are spaced apart a distance that is substantially less than the outer diameter of bail legs 8. Inner portion 34 of slot 30 lacks tabs 36 and is thus wider. In fact, inner portion 34 of slot 30 is equal to the width of or is slightly wider than the outer diameter of bail legs 8.

Figure 1:
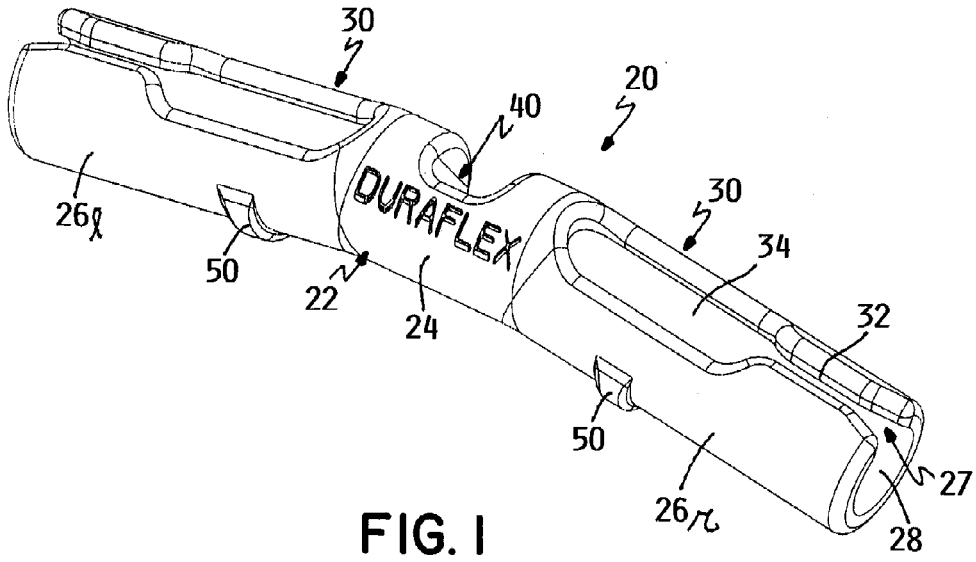
FIG. 1 is a front perspective view of a bucket bail grip according to this invention.
Figure 2:
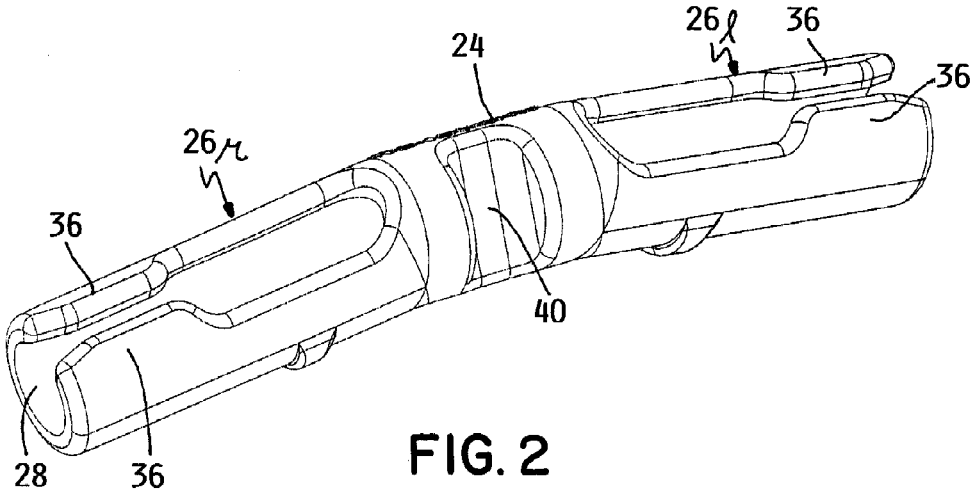
FIG. 2 is a perspective view similar to FIG. 1, but showing the bail grip from the rear and not the front.
Figure 3:
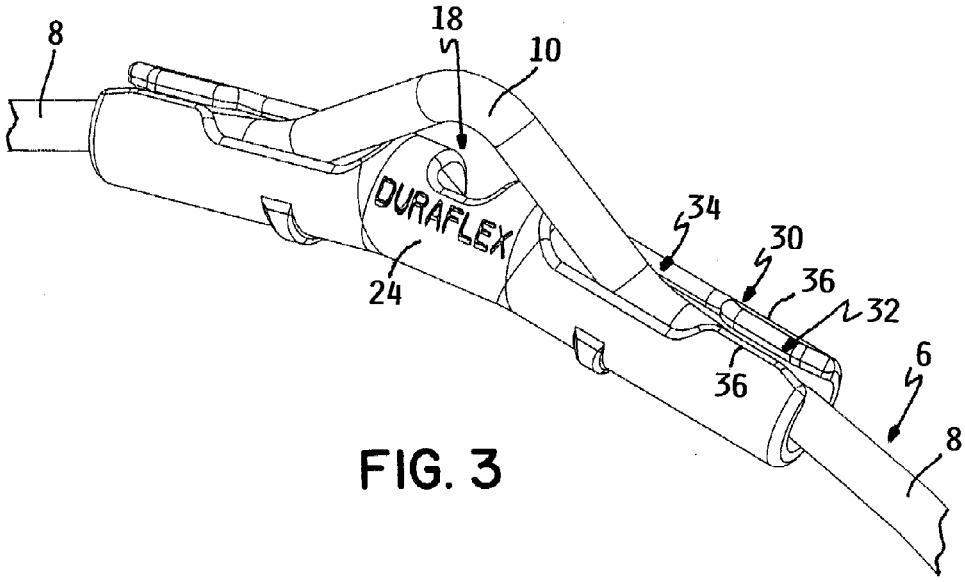
FIG. 3 is a front perspective view of the bucket bail grip of FIG. 1, particularly showing the bucket bail grip having been installed on the central portion of a bucket bail.
Figure 4:
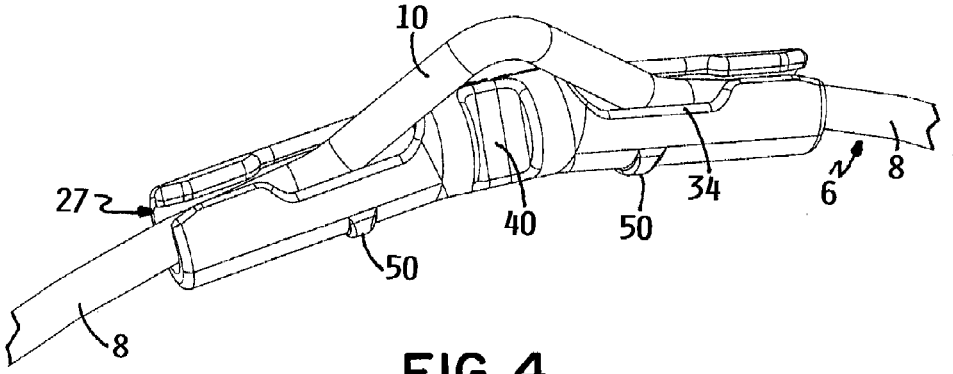
FIG. 4 is a perspective view similar to FIG. 3, but showing the bail grip and the bucket bail from the rear and not the front.

Slots 30 are designed to allow bail grip 20 to be snap fit onto the upper ends of bail legs 8 adjacent hook 10. The user can simply position bail grip 20 underneath the central portion of bail 6 with one slot 30 being located adjacent the upper ends of each bail leg 8. If the user than pushes upwardly on bail grip 20 to force bail grip 20 up onto bail legs 8, outer portions 32 of slots 30 can open up to receive bail legs 8 due to a limited amount of flexibility provided in bail grip 20, i.e. tabs 36 can move apart sufficiently to permit the upper ends of bail legs 8 to move down into the hollow bores 27 of arms 26 of bail grip 20. Once the upper ends of bail legs 8 pass down past tabs 36, outer portions 32 of slot 30 will snap back to move tabs 36 into their usual position, thus locking bail grip 20 onto the upper ends of bail legs 8. In this position, the inverted legs forming hook 10 can then simply extend upwardly and out of bail grip 20 through the wider inner portions 34 of slots 30. See FIGS. 3 and 4.

Figure 7:
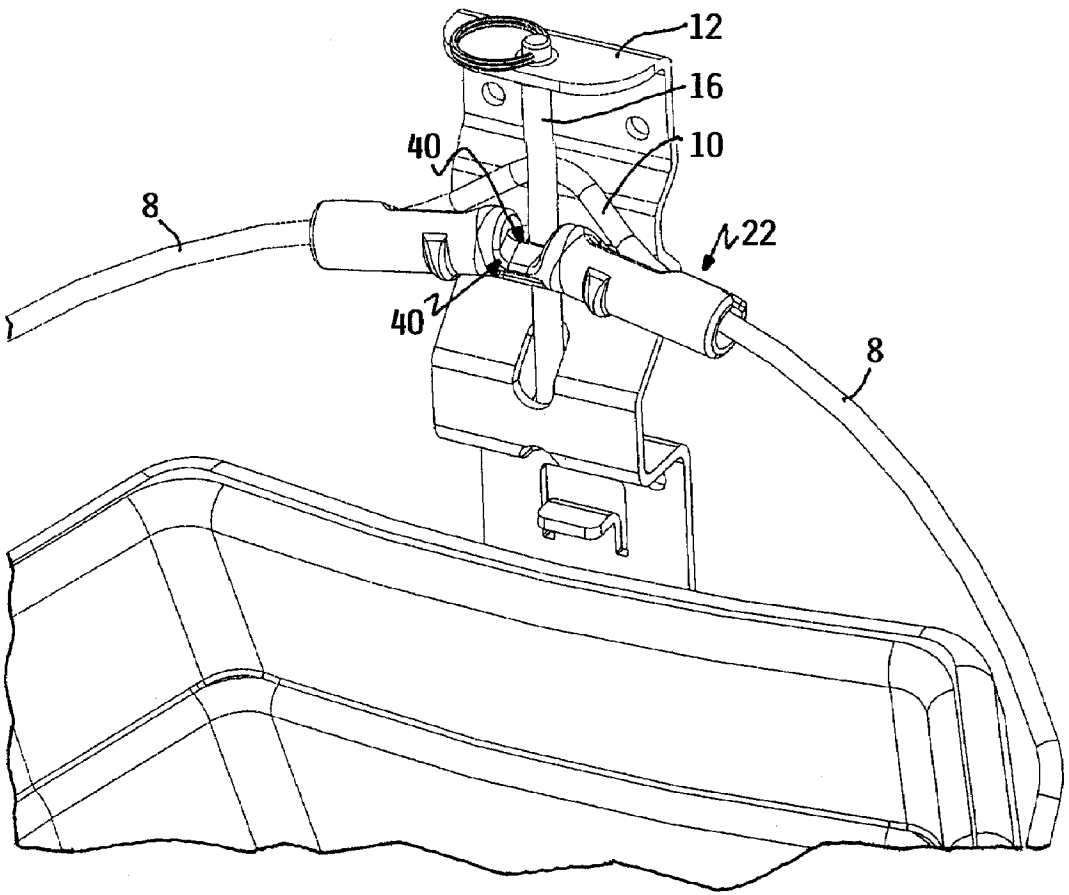
FIG. 7 is a perspective view similar to FIG. 5, but showing a second embodiment of a bail grip having dual front and rear notches on the central hub of the bail grip.

Central hub 24 of bail grip 20 has a groove or notch 40 along at least one side, namely at the side of bail grip 20 that faces wall bracket 12 when bail grip 20 is installed on bail 6 and bucket 2 is hung from bracket 12. Bail grip 20 would be installed on bail 6 with notch 40 facing the flat back of bucket 2 since this is the side of bucket 2 that is normally disposed adjacent wall bracket 12. This requires a bit of attention when snapping bail grip 20 onto bail 6. If desired, each side of bail grip 20 could have a notch 40 as shown in FIG. 7, or notch 40 could extend around the entire circumference of central hub 24, so that it would not matter which way bail grip 20 was oriented at the time it is snapped onto bail 6.

Notch 40 is provided to ensure that recess 18 formed by hook 10 on bail 6 is still sufficiently open so that locking pin 16 can still pass down through hook 10. In fact, notch 40 is about the same width as the diameter of locking pin 16 to allow notch 40 to closely fit around and on either side of locking pin 16. See FIGS. 5 and 6.

Bail grip 20 is preferably molded as a single piece out of a durable plastic material. The plastic material preferably should be strong enough to remain relatively rigid and self-supporting when bail grip 20 is gripped by a user who is carrying bucket 2. Bail grip 20 contacts the underside of bail 6 adjacent each side of hook 10 to support bail grip 20 at two spaced contact areas to limit any deflection of bail grip 20 into recess 18 defined by hook 10. This also keeps bail grip 20 centered on bail 6. In addition, the plastic material used to form bail grip 20 is also strong enough so that it will also substantially resist deforming into recess 18 defined by hook 10 when the user is gripping bail grip 20 and carrying bucket 2. However, the plastic material should have enough flexibility when molded so that outer portions 32 of slots 30 will flex sufficiently to allow bail grip 20 to be snapped onto the upper ends of bail legs 8.

The bottom of bail grip 20 preferably is roughened with a pair of ribs 50 to allow the user to better hold onto and grip bail grip 20. The number, shape and spacing of such ribs 50 can obviously be varied. Alternatively the bottom of bail grip 20 could also be provided with a soft rubber cushion or some other flexible cushioning material.

Bail grip 20 of this invention allows the user to more easily and comfortably carry bucket 2. This is particularly helpful and important when bucket 2 is fully loaded. This is true even for a bucket having a pivotal bail 6 with a central hook 10 for hanging bucket 2 from a wall bracket 12. Bail grip 20 of this invention does not close off recess 18 defined by hook 10, but is instead designed to specifically leave recess 18 sufficiently open to receive locking pin 16 of bracket 12.

Various other modifications of this invention will be apparent to those skilled in the art. Thus, the scope of this invention will be limited only by the appended claims.

We claim:

1. A bail grip for use on a bail of a bucket, the bail having a pair of bail legs with upper ends with the upper ends of the bail legs being joined to opposite sides of an inverted hook that forms a recess, which comprises:

(a) a bail grip body that is shaped to at least partially lie along the upper ends of the bail legs, the bail grip body having a central hub with a solid interior and laterally extending arms with at least a partially hollow interior, the arms extending laterally outwardly from opposite sides of the central hub; and (b) a slot provided in an exterior surface in each laterally extending arm of the bail grip body to permit access to the hollow interior in each arm, each slot having a narrowed portion lying along the exterior surface in each arm with the narrowed portion being formed by two inwardly protruding, facing fixed shoulders or tabs on facing edges of the slot to snap fit around the upper ends of the bail legs such that a portion of an upper end of a bail leg is received in the hollow interior in each arm after snap fitting through the slot in each arm to attach the bail grip body to the bail legs, each slot also being configured to allow the hook to pass outwardly through the slot and upwardly above the central hub of the bail grip body such that at least a portion of the recess formed by the hook lies above the central hub of the bail grip body without any portion of the upper ends of the bail legs or the hook passing through the interior of the central hub.

2. The bail grip of claim 1, wherein the open portion of the recess is large enough to receive a locking pin on a wall bracket from which the bucket is hung.

3. The bail grip of claim 2, wherein the central hub of the bail grip body includes a notch for further accommodating passage of the locking pin.

4. The bail grip of claim 3, wherein the notch has a width approximately the same or slightly greater than an outer diameter of the locking pin.

5. The bail grip of claim 3, further including at least a pair of the notches located on opposite exterior sides, respectively, of the central hub of the bail grip body such that one notch faces the locking pin regardless of how the bail grip body is installed onto the upper ends of the bail legs.

* * * * *